US009843091B2

(12) United States Patent
Mow et al.

(10) Patent No.: US 9,843,091 B2
(45) Date of Patent: Dec. 12, 2017

(54) ELECTRONIC DEVICE WITH CONFIGURABLE SYMMETRIC ANTENNAS

(71) Applicant: Apple Inc., Cupertino, CA (US)

(72) Inventors: Matthew A. Mow, Los Altos, CA (US); Xu Han, San Jose, CA (US); James G. Judkins, Campbell, CA (US); Liang Han, Sunnyvale, CA (US); Mattia Pascolini, San Francisco, CA (US); Ming-Ju Tsai, Cupertino, CA (US); Nanbo Jin, Milpitas, CA (US); Thomas E. Biedka, San Jose, CA (US); Victor C. Lee, Sunnyvale, CA (US); Yuehui Ouyang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 267 days.

(21) Appl. No.: 14/701,323

(22) Filed: Apr. 30, 2015

(65) Prior Publication Data

US 2016/0322699 A1 Nov. 3, 2016

(51) Int. Cl.
*H01Q 1/24* (2006.01)
*H01Q 13/10* (2006.01)
(Continued)

(52) U.S. Cl.
CPC ..... *H01Q 1/243* (2013.01); *H01Q 5/321* (2015.01); *H01Q 5/328* (2015.01); *H01Q 5/335* (2015.01);
(Continued)

(58) Field of Classification Search
CPC ..... H01Q 1/243; H01Q 13/10; H01Q 13/103
(Continued)

(56) References Cited

U.S. PATENT DOCUMENTS 6,737,439 B2 5/2004 Kinghorn et al.
6,903,693 B1 6/2005 Lee et al.
(Continued)

FOREIGN PATENT DOCUMENTS

EP 2500979 9/2012
EP 2528165 11/2012
(Continued)

OTHER PUBLICATIONS

Jin et al., U.S. Appl. No. 14/691,304, filed Apr. 20, 2015.

*Primary Examiner* — Dameon E Levi
*Assistant Examiner* — David Lotter
(74) *Attorney, Agent, or Firm* — Treyz Law Group, P.C.; G. Victor Treyz; Tianyi He

(57) ABSTRACT

An electronic device may have wireless circuitry with antennas. An antenna resonating element arm for an antenna may be formed from peripheral conductive structures running along the edges of a device housing that are separated from a round by an elongated opening. The electronic device may have a central longitudinal axis that divides the antenna resonating element arm and other antenna structures into symmetrical halves that exhibit mirror symmetry with respect to the central longitudinal axis. The antenna structures may include symmetrical slot antenna resonating elements on opposing sides of the central longitudinal axis. Electrical components such as switches and antenna tuning inductors may be coupled to the antenna structures in a configuration that is symmetrical with respect to the central longitudinal axis. The electrical components may be used to place the antenna structures in an unflipped configuration or in a symmetrical flipped configuration.

20 Claims, 8 Drawing Sheets

(51) Int. Cl.
*H01Q 9/42* (2006.01)
*H01Q 5/321* (2015.01)
*H01Q 5/328* (2015.01)
*H01Q 5/335* (2015.01)

(52) U.S. Cl.
CPC ..... *H01Q 9/42* (2013.01); *H01Q 13/10* (2013.01); *H01Q 13/103* (2013.01)

(58) Field of Classification Search
USPC ..... 343/702
See application file for complete search history.

(56) References Cited

U.S. PATENT DOCUMENTS

| | | | | |
|---|---|---|---|---|
| 7,187,329 | B2 | 3/2007 | Okado | |
| 7,876,274 | B2 | 1/2011 | Hobson et al. | |
| 8,270,914 | B2 | 9/2012 | Pascolini et al. | |
| 8,489,162 | B1 * | 7/2013 | Dou | H01Q 1/243 343/746 |
| 8,531,344 | B2 | 9/2013 | Ayatollahi et al. | |
| 8,610,629 | B2 | 12/2013 | Pascolini et al. | |
| 8,665,164 | B2 | 3/2014 | Hill et al. | |
| 8,798,554 | B2 | 8/2014 | Darnell et al. | |
| 8,836,587 | B2 | 9/2014 | Darnell et al. | |
| 8,860,619 | B2 | 10/2014 | Nyssen | |
| 8,872,706 | B2 | 10/2014 | Caballero et al. | |
| 8,947,302 | B2 | 2/2015 | Caballero et al. | |
| 9,024,823 | B2 | 5/2015 | Bevelacqua | |
| 2011/0241949 | A1 | 10/2011 | Nickel et al. | |
| 2012/0112969 | A1 | 5/2012 | Caballero et al. | |
| 2013/0169490 | A1 | 7/2013 | Pascolini et al. | |
| 2013/0201067 | A1 | 8/2013 | Hu et al. | |
| 2013/0257659 | A1 | 10/2013 | Darnell et al. | |
| 2014/0162572 | A1 * | 6/2014 | Hirabayashi | H04B 7/04 455/73 |
| 2014/0266922 | A1 | 9/2014 | Jin et al. | |
| 2014/0266923 | A1 | 9/2014 | Zhou et al. | |
| 2014/0266938 | A1 | 9/2014 | Ouyang et al. | |
| 2014/0266941 | A1 | 9/2014 | Vazquez et al. | |
| 2014/0292598 | A1 | 10/2014 | Bevelacqua et al. | |
| 2014/0306857 | A1 | 10/2014 | Bevelacqua | |
| 2014/0327584 | A1 | 11/2014 | Chang | |
| 2014/0333495 | A1 | 11/2014 | Vazquez et al. | |
| 2014/0333496 | A1 | 11/2014 | Hu et al. | |

FOREIGN PATENT DOCUMENTS

| | | |
|---|---|---|
| EP | 2621017 | 7/2013 |
| TW | 201507264 | 2/2015 |
| WO | 2016/028592 | 2/2016 |
| WO | 2016/101871 | 6/2016 |

* cited by examiner

ELECTRONIC DEVICE WITH CONFIGURABLE SYMMETRIC ANTENNAS

BACKGROUND

This relates generally to electronic devices and, more particularly, to electronic devices with wireless communications circuitry.

Electronic devices often include wireless circuitry with antennas. For example, cellular telephones, computers, and other devices often contain antennas for supporting wireless communications.

It can be challenging to form electronic device antenna structures with desired attributes. In some wireless devices, the presence of conductive structures such as conductive housing structures can influence antenna performance. Antenna performance may not be satisfactory if the housing structures are not configured properly and interfere with antenna operation. Device size can also affect performance. It can be difficult to achieve desired performance levels in a compact device, particularly when the compact device has conductive housing structures and is used in a variety of operating environments.

It would therefore be desirable to be able to provide improved wireless circuitry for electronic devices such as electronic devices that include conductive housing structures.

SUMMARY

An electronic device may have wireless circuitry with antennas. An antenna resonating element arm for an antenna may be formed from peripheral conductive structures running along the edges of a device housing that are separated from a ground by an elongated opening. The resonating element arm may be an inverted-F antenna resonating element arm.

The electronic device may have a central longitudinal axis that divides the antenna resonating element arm and other antenna structures into symmetrical halves that exhibit mirror symmetry with respect to the central longitudinal axis. The antenna structures may include symmetrical slot antenna resonating elements on opposing sides of the central longitudinal axis.

Electrical components such as switches and antenna tuning inductors may be coupled to the antenna structures in a configuration that is symmetrical with respect to the central longitudinal axis. The electrical components may be used to place the antenna structures in an unflipped configuration or in a symmetrical flipped configuration. In the unflipped configuration, the antenna structures form a hybrid antenna with an antenna feed on one side a the central longitudinal axis. In the flipped configuration, the antenna structures form a symmetrical hybrid antenna with an antenna feed on an opposing side of the central longitudinal axis.

Control circuitry in the electronic device may be used to configure the antenna structures to optimize antenna performance in real time. The control circuitry may gather data to use in determining when to change the antenna structures between the flipped and unflipped states from sensors, impedance measurement circuitry, wireless circuitry that monitors signal strengths, or other suitable circuitry in the electronic device.

DETAILED DESCRIPTION

Figure 1:
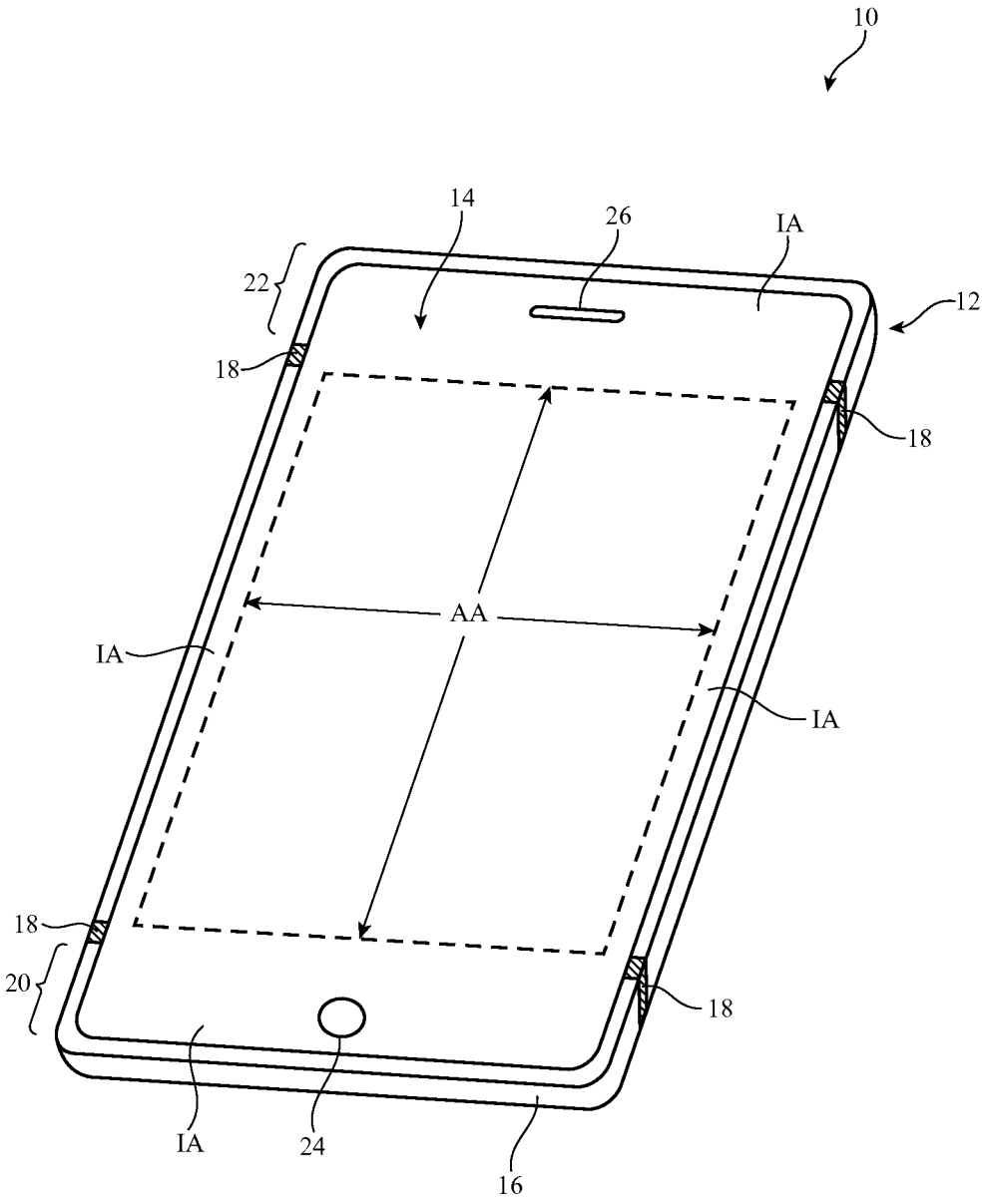
FIG. 1 is a perspective view of an illustrative electronic device in accordance with an embodiment.

Electronic devices such as electronic device 10 of FIG. 1 may be provided with wireless communications circuitry. The wireless communications circuitry may be used to support wireless communications in multiple wireless communications bands.

The wireless communications circuitry may include one more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalk or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a television, a set-top box, a desktop computer, a computer monitor into which a computer has been integrated, or other suitable electronic equipment.

Device 10 may include a housing such as housing 12. Housing 12. which may sometimes be referred to as a case, may be formed of plastic, glass, ceramics, fiber composites, metal (e.g., stainless steel, aluminum, etc,), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch.

Display 14 may include pixels formed from light-emitting diodes (LEDs), organic LEDs (OLEDs), plasma cells, electrowetting pixels, electrophoretic pixels liquid crystal display (LCD) components, or other suitable pixel structures. A display cover layer such as a layer of clear glass or plastic may cover the surface of display 14 or the outermost layer of display 14 may be formed from a color filter layer, thin-film, transistor layer, or other display layer. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 max be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

It is it necessary for peripheral housing structures 16 to have a uniform cross-section. For example, the top portion of peripheral housing structures 16 may, if desired, have an inwardly protruding lip that helps hold display 14 in place. The bottom portion of peripheral housing structures 16 may also have an enlarged lip (e.g., in the plane of the rear surface of device 10). Peripheral housing structures 16 may have substantially straight vertical sidewalls, may have sidewalk that are curved, or may have other suitable shapes. In some configurations (e.g., when peripheral housing structures 16 serve as a bezel for display 14), peripheral housing structures 16 may run around the lip of housing 12 (i.e., peripheral housing structures 16 may cover only the edge of housing 12 that surrounds display 14 and not the rest of the sidewalls of housing 12).

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of 12 may have one or more, two or more, or three or more portions.

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a midplate) that spans the walls of housing 12 (i.e., a substantially rectangular sheet formed from one or more parts that is welded or otherwise connected between opposing sides of member 16 or other sheet metal parts that provide housing 12 with structural support). Device 10 may also include conductive structures such as printed circuit boards, components mounted on printed circuit boards, and other internal conductive structures. These conductive structures, which may be used in forming a ground plane in device 10, may be located in the center of housing 12 and may extend under active area AA of display 14.

In regions 22 and 20, openings may be formed within the conductive structures of device 10 (e.g., between peripheral conductive housing structures 16 and opposing conductive ground structures such as conductive housing midplate or rear housing wall structures, a primed circuit board, and conductive electrical components in display 14 and device 10). These openings, which may sometimes be referred to as gaps, may be filled with air, plastic, and other dielectrics and may be used in forming slot antenna resonating elements for one or more antennas in device 10.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22. In configurations for device 10 with narrow U-shaped openings or other openings that run along the edges of device 10, the ground plane of device 10 can be enlarged to accommodate additional electrical components (integrated circuits, sensors, etc.)

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with peripheral gap structures. For example, peripheral conductive housing structures 16 may be provided with one or more gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be for example, two peripheral conductive segments in peripheral housing structures 16 (e.g., in an arrangement with two of gaps 18), three peripheral conductive segments (e.g., in an arrangement with three of gaps 18), four peripheral conductive segments (e.g., in an arrangement with four gaps 18, etc.). The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Figure 2:
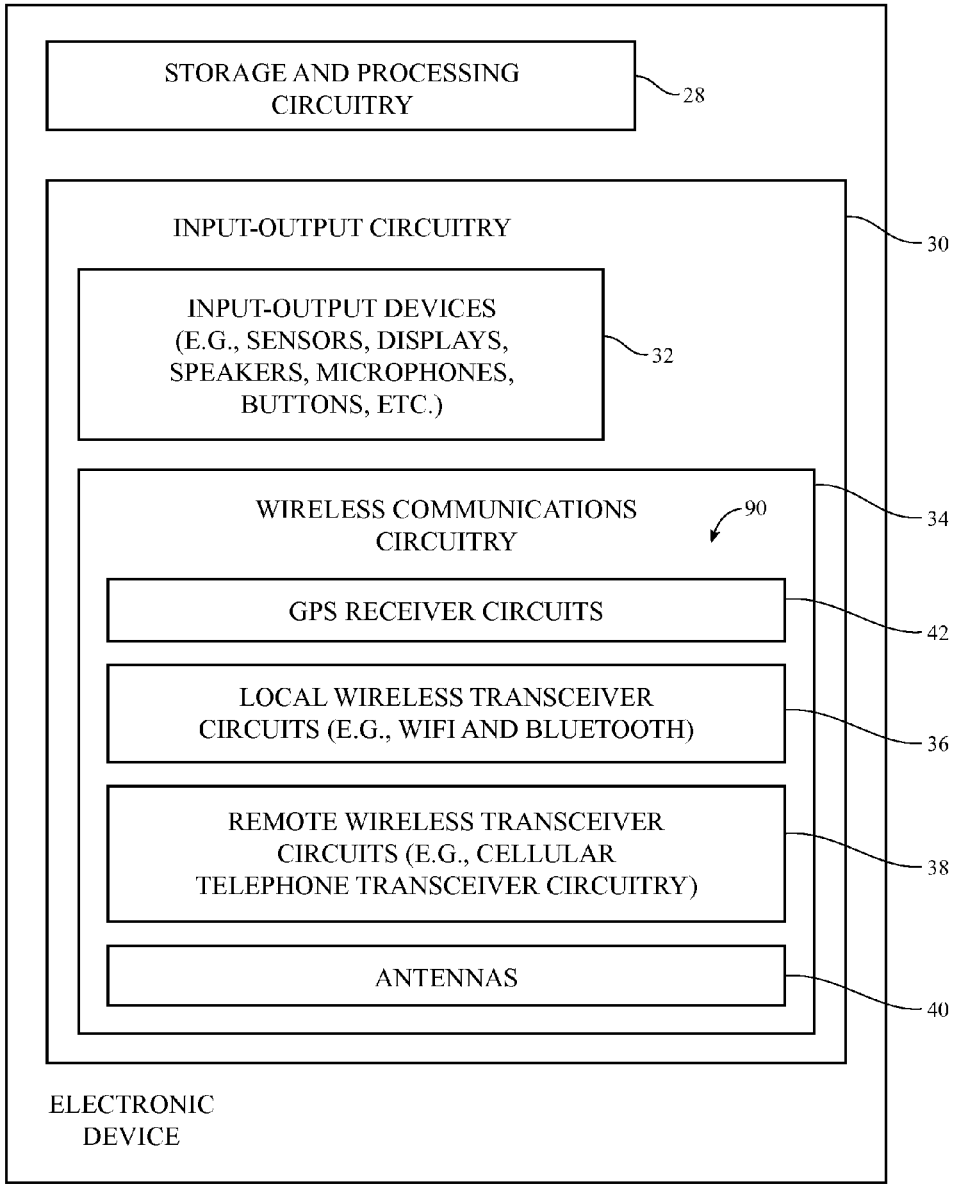
FIG. 2 is a schematic diagram of illustrative circuitry in an electronic device in accordance with an embodiment.

A schematic diagram showing illustrative components that may be used in device 10 of FIG. 1 is shown in FIG. 2. As shown in FIG. 2, device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. This processing circuitry may be based on one or more microprocessors, microcontrollers, digital signal processors, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, cellular telephone protocols, multiple-input and multiple-output (MIMO) protocols, antenna diversity protocols, etc.

Input-output circuitry 30 may include input-output devices 32. Input-output devices 32 may be used to allow data to be supplied to device 10 and to allow data to be provided from device 10 to external devices. Input-output devices 32 may include user interface devices, data port devices, and other input-output components. For example, input-output devices 32 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, motion sensors (accelerometers), capacitance sensors, proximity sensors, fingerprint sensors e.g., a fingerprint sensor integrated with a button such as button 24 of FIG. 1 or a fingerprint sensor that takes the place of button 24), etc.

Input-output circuitry 30 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 90 for handling various radio-frequency communications bands. For example, circuitry 34 may include transceiver circuitry 36, 38, and 42. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in frequency ranges such as a low communications band from 700 to 960 MHz, a low midband from 1400-1520 MHz, a midband from 1710 to 2170 MHz, and a high band from 2300 to 2700 MHz or other communications bands between 700 MHz and 2700 MHz or other suitable frequencies (as examples). Circuitry 38 may handle voice data and non-voice data. Wireless communications circuitry 34 can include circuitry for other short-range and long-range wireless links if desired. For example, wireless communications circuitry 34 may include 60 GHz transceiver circuitry, circuitry for receiving television and radio signals, paging system transceivers, near field communications (NFC) circuitry, etc. Wireless communications circuitry 34 may include global positioning system (GPS) receiver equipment such as GPS receiver circuitry 42 for receiving GPS signals at 1575 MHz or for handling other satellite positioning data. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
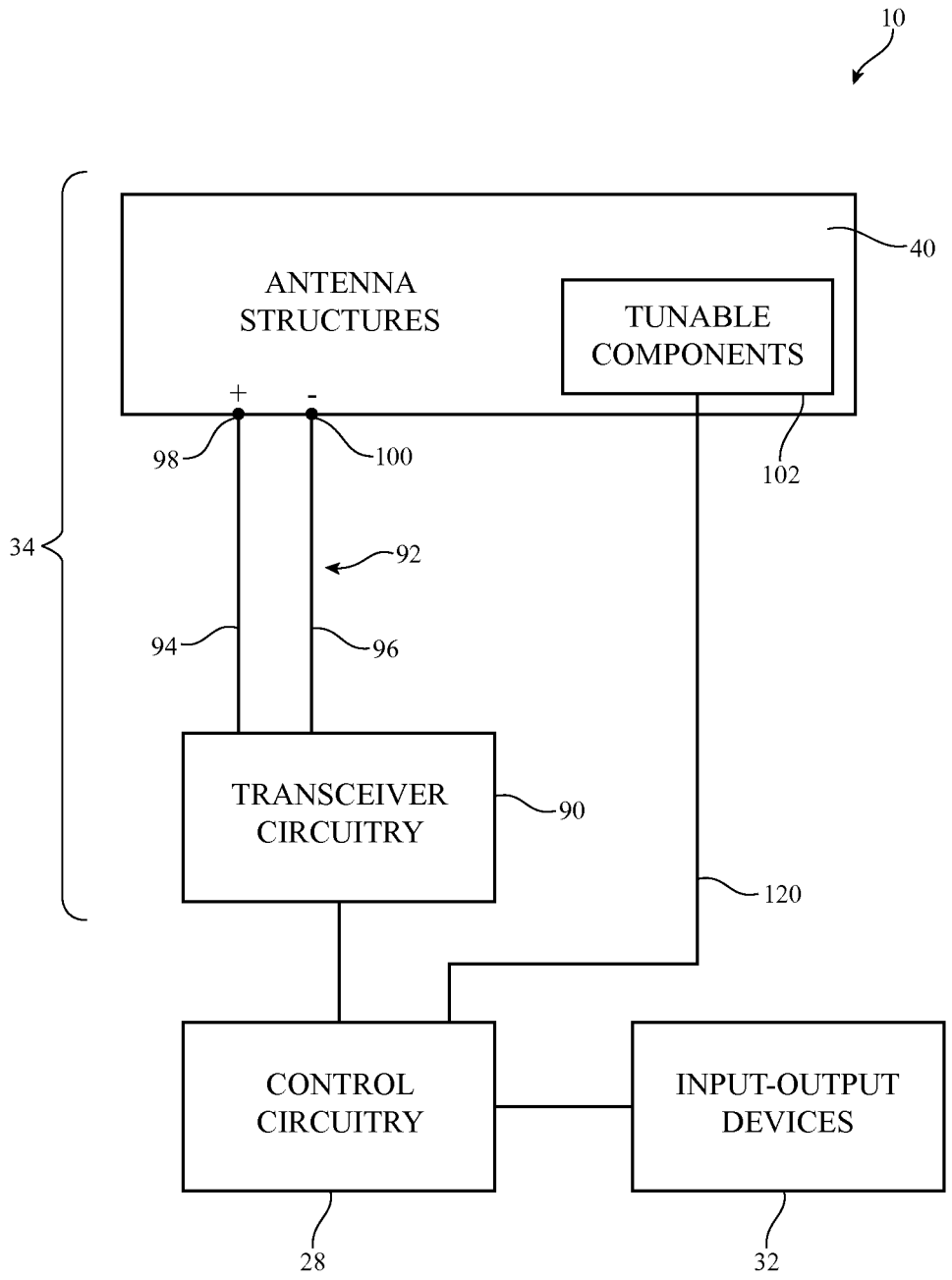
FIG. 3 is a schematic diagram of illustrative wireless circuitry in accordance with an embodiment.

As shown in FIG. 3, transceiver circuitry 90 in wireless circuitry 34 may be coupled to antenna structures 40 using paths such as: path 92. Wireless circuitry 34 may be coupled to control circuitry 28. Control circuitry 28 may be coupled to input-output devices 32. Input-output devices 32 may supply output from device 10 and may receive input from sources that are external to device 10.

To provide antenna structures such as antenna(s) 40 with the ability to cover communications frequencies of interest, antenna(s) 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna(s) 40 may be provided with adjustable circuits such as tunable components 102 to tune antennas over communications bands of interest. Tunable components 102 may be part of a tunable filter or tunable impedance matching network, may be part of an antenna resonating element, may span a gap between an antenna resonating element and antenna ground, etc. Tunable components 102 may include tunable inductors, tunable capacitors, or other tunable components. Tunable components such as these may be based on switches and networks of fixed components, distributed metal structures that produce associated distributed capacitances and inductances, variable solid state devices for producing variable capacitance and inductance values, tunable filters, or other suitable tunable structures. During operation of device 10, control circuitry 28 may issue control signals on one or more paths such as path 120 that adjust inductance values, capacitance values, or other parameters associated with tunable components 102, thereby tuning antenna structures 40 to cover desired communications bands.

Path 92 may include one or more transmission lines. As an example, signal path 92 of FIG. 3 may be a transmission line having a positive signal conductor such as line 94 and a ground signal conductor such as line 96. Lines 94 and 96 may form parts of a coaxial cable or a microstrip transmission line (as examples). A matching network formed from components such as inductors, resistors, and capacitors may be used in matching the impedance of antenna(s) 40 to the impedance of transmission line 92. Matching network components may be provided as discrete components (e.g., surface mount technology components) or may be formed from housing structures, printed circuit hoard structures, traces on plastic supports, etc. Components such as these may also be used in forming filter circuitry in antenna(s) 40 and may be tunable and/or fixed components.

Transmission line 92 may be coupled to antenna feed structures associated with antenna structures 40. As an example, antenna structures 40 may form an inverted-F antenna, a slot antenna, a hybrid inverted-F slot antenna or other antenna having an antenna feed with a positive antenna feed terminal such as terminal 98 and a ground antenna feed terminal such as ground antenna feed terminal 100. Positive transmission line conductor 94 may be coupled to positive antenna feed terminal 98 and ground transmission line conductor 96 may be coupled to ground antenna feed terminal 92. Other types of antenna feed arrangements may be used if desired. For example, antenna structures 40 may be fed using multiple feeds. The illustrative feeding configuration of FIG. 3 is merely illustrative.

Antenna structures 40 may include components and antenna resonating element structures that are configured to implement redundant antennas. This allows device 10 to switch an optimum antenna into use during the operation of device 10. Antenna performance can be affected by the presence of external objects along certain portions of housing 12 or other environmental effects. By using redundant antenna structures, the location of the transmitting and receiving antennas in device 10 can be altered in real time to avoid wireless performance degradation.

As an example, antenna structures 40 may include symmetrical structures on both the left and right sides of device 10 that serve as redundant antennas. These structures may be used in forming an antenna that operates on either the left or right side of device 10, as needed. In one configuration, for example, antenna structures 40 may be used to form an antenna that operates primarily on the left of device 10 in a communications band of interest. In another configuration, adjustable circuitry in antenna structures 40 can be configured to flip the antenna so that the antenna operates primarily on the right side of device 10 in the communications band of interest. Switching circuitry can also be used to select between antennas on the upper and lower ends of device 10 and to adjust which antenna feeds are used by transceiver circuitry 90.

Any suitable information from sensors or other data sources can be used by device 10 in determining how to configure the antenna structures of device 10. With one suitable arrangement, control circuitry 28 may use an impedance measurement circuit to gather antenna impedance information in real time. Control circuitry 28 may also gather proximity information from a proximity sensor (see e.g., sensor 32 of FIG. 2), received signal strength information (e.g., signal strength information or other link performance metrics from a baseband processor or other wireless circuit), information from an orientation sensor, and other information for determining when antenna structures 40 are being affected by the presence of nearby external objects or are otherwise being affected. In response, control circuitry 28 may reconfigure antenna structures 40 to ensure that antenna performance is optimized (e.g., by implementing a reconfigurable antenna with a feed on the left or right of device 10 and/or by selecting between upper and lower antennas). If desired, control circuitry 28 may also adjust an adjustable inductor or other tunable component 102 to counteract antenna detailing due to the presence of external objects and/or to extend the coverage of antenna structures 40 (e.g., to cover desired communications bands that extend over a range of frequencies larger than antenna structures 40 would cover without tuning). Device 10 may be provided with redundant tuning components so that both the left and right antennas may be tuned.

Figure 4:
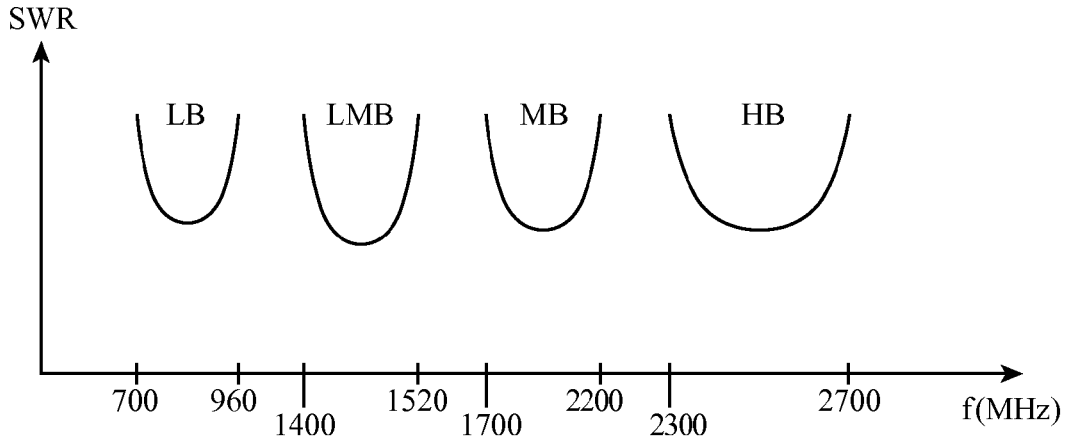
FIG. 4 is a graph in which antenna performance (standing-wave ratio) has been plotted as a function of operating frequency in accordance with an embodiment.

Antenna structures 40 may include resonating element structures and components (e.g., components 102) that are arranged symmetrically with respect to the center axis of device 10. This allows antennas to be formed in either an unflipped or flipped (mirror) configuration as desired to optimize antenna performance. Antenna structures 40 may be configured to form any suitable types of antenna. With one suitable arrangement, which is sometimes described herein as an example, antenna structures 40 are used to implement a hybrid inverted-F-slot antenna that includes both inverted-F and slot antenna resonating elements. A graph of antenna performance (standing wave ratio SWR) as a function of operating frequency for an illustrative hybrid antenna is shown in FIG. 4. As shown in FIG. 4, the hybrid antenna may exhibit resonances in multiple communications bands such as a low band LB from 700-960 MHz, a low-midband LMB from 1400-1520 MHz, a midband MB from 1700-2200 MHz, and a high band HB from 2300-2700 MHz. Other frequencies (e.g., local area network frequencies in a 5 GHz band) may also be supported (e.g., using a separate monopole, etc.). The hybrid antenna may use the inverted-F antenna resonating element to support coverage in the low band LB and midband MB, and may use slot resonances associated with one or more slot antenna resonating elements to support coverage in low-midband LMB and high band HB (as an example). Other configurations may be used for forming a hybrid antenna for device 10, if desired.

Figure 5:
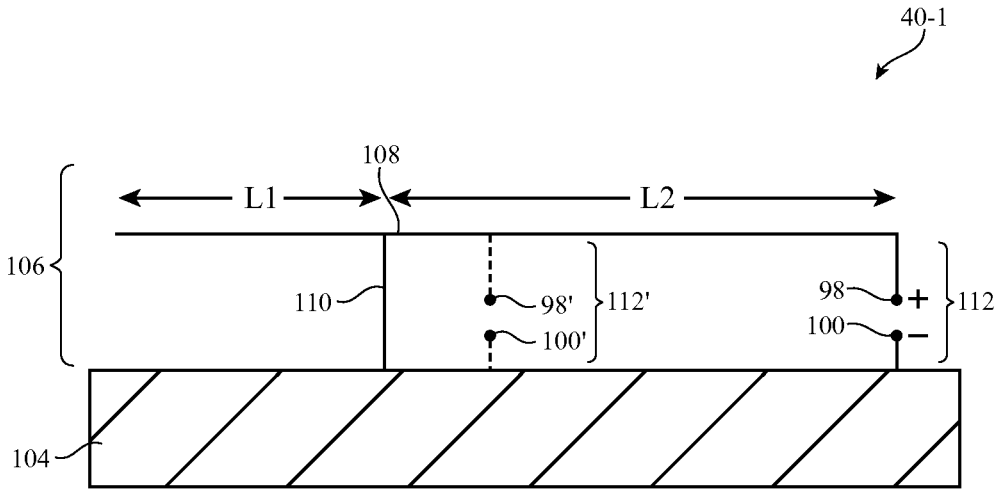
FIG. 5 is a schematic diagram of an illustrative dual branch inverted-F antenna in accordance with an embodiment.

An illustrative inverted-F antenna is shown in FIG. 5. As shown in FIG. 5, inverted-F antenna 40-1 may have inverted-F antenna resonating element 106 and antenna ground 104. Antenna ground 104 may be formed from conductive housing structures, metal traces on a printed circuit or other substrate, midplate structures, conductive components in device 10, or other ground plane structures in device 10. Antenna resonating element 106 may have a main arm such as arm 108. Arm 108 may be formed from conductive housing structures such as peripheral conductive housing structures 16 (e.g., a segment of peripheral conductive housing structures 16 that extends along the periphery of device 10 between respective gaps 18) or may be formed from other conductive structures. A return path such as return path 110 may be coupled between arm 108 and ground 104. If desired, return path 110 may be formed by a configurable switch to support antenna flipping operations. Antenna 40-1 may have an antenna feed that is coupled between arm 108 and ground 104 in parallel with return path 110. For example, antenna 40-1 may have an antenna feed such as antenna feed 112 at the tip of one of the ends of arm 108 (i.e., a feed that includes positive antenna feed terminal 98 and ground antenna feed terminal 100) or may have an antenna feed located elsewhere in antenna 40-1 (see, e.g., feed 112' with positive feed terminal 98' and ground feed terminal 100'). Indirect feeding arrangements may also be used, if desired.

Arm 108 of antenna 40-1 of FIG. 5 may have a first branch of length L1 that supports an antenna resonance in midband MB and a second branch of length L2 (longer than L1) that supports an antenna resonance in low band LB. In a hybrid antenna, inverted-F antenna resonating element 106 may be combined with one or more slot antenna resonating elements to extent the frequency coverage of the antenna.

Figure 6:
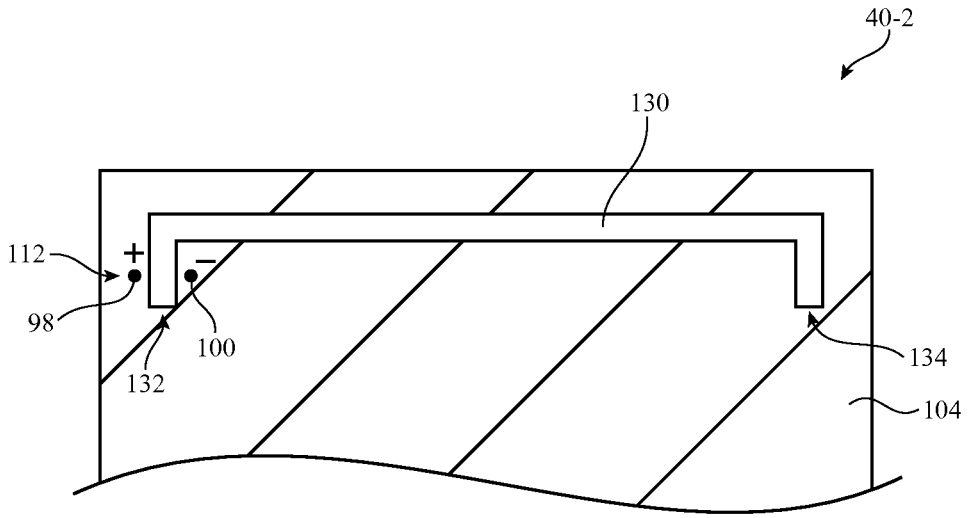
FIG. 6 is a schematic diagram of an illustrative slot antenna with two closed ends in accordance with an embodiment of the present invention.

An illustrative slot antenna resonating element is shown in FIG. 6. Slot antenna resonating element 40-2 has been formed from slot 130 in ground plane 104. Slot 130 may be filled with air, plastic, or other dielectric. Illustrative slot resonating element 40-2 forms a slot antenna that is directly feed at feed 112 using positive antenna feed terminal 98 and ground antenna feed terminal 100. Other types of feeding arrangements may be used if desired (e.g., indirect feeding arrangement in which the slot resonating element is fed through near-field coupling from an indirect feed structure).

The slot resonating element of FIG. 6 has first closed end 132 and second closed end 134 at the opposing end of slot 130. Slots such as slot 130 that have two closed ends may sometimes be referred to as closed slots.

Figure 7:
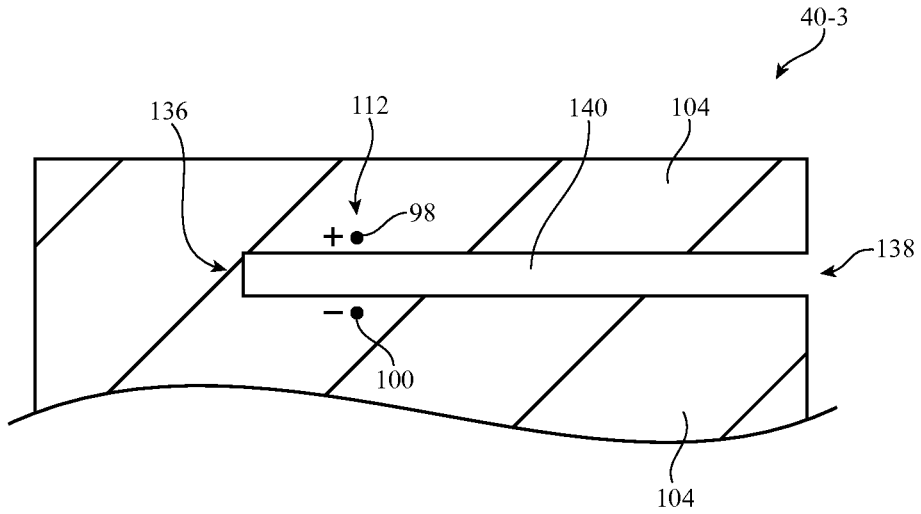
FIG. 7 is a diagram of illustrative slot antenna with an open end and a closed end in accordance with an embodiment.

An illustrative open slot is shown in the example of FIG. 7. As shown in FIG. 7, slot 140 in ground 104 has closed end 136 and opposing open end 138. Open end 138 is surrounded by dielectric (e.g., air, plastic, etc.), whereas closed end 136 is surrounded by portions of ground 104. Slot 140 may form a slot antenna resonating element for slot antenna 40-3. Slot antenna 40-3 of FIG. 7 is directly feed at feed 112 using positive antenna feed terminal 98 and ground antenna feed terminal 100. Other types of feeding arrangements may be used (e.g., indirect feeding). The arrangement of FIG. 7 is merely illustrative.

Figure 8:
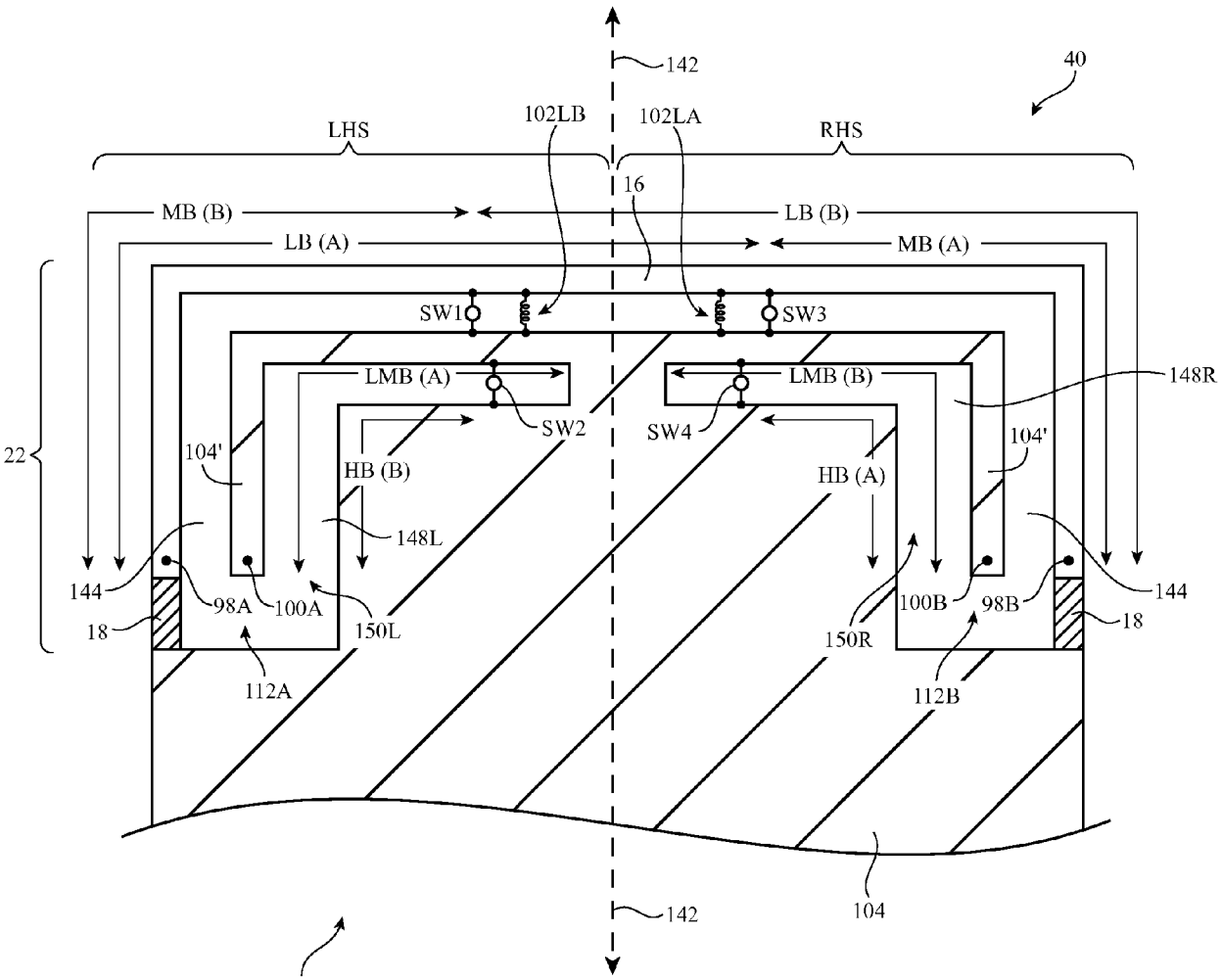
FIG. 8 is a diagram of illustrative antenna structures in accordance with an embodiment.

FIG. 8 is a top interior view of a portion of electronic device 10 in which antenna structures 40 have been formed. Antenna structures 40 may include symmetric structures that that exhibit mirror symmetry along central axis 142. Device 10 may have an elongated rectangular shape and axis 142 may form a central longitudinal axis for device 10 that extends along the elongated dimension of device 10. Axis 142 may bisect device 10, antenna structures 40, and housing 12 into left and right portions (left-hand side structures LHS and right-hand side structures RHS of FIG. 8). Left-hand structures LHS may be mirror images of right hand structures RHS (i.e., if device 10 were to be turned over by rotating device 10 180° about axis 142, the LHS and RHS would swap places). Components such as switches SW1 and SW3 may be located at equal distances from axis 142. Components such as switches SW2 and SW4 may likewise be located at equal distances from axis 142. Tuning components such as inductors 102LB and 102LA may be placed on opposing sides of device 10 at equal distances from axis 142.

The symmetrical design of antenna structures 40 allows antenna structures 40 to be configured to operate in a normal (unflipped) configuration in some situations and to be configured to operate in a flipped (mirror reversed) configuration in other situations. This may allow antenna operation to be optimized in real time (e.g., to avoid antenna degradation due to blocking from external objects, etc.).

Antenna structures 40 may form first and second hybrid antennas for unflipped and flipped operation, respectively. The hybrid antennas may be inverted-F-slot antennas. Peripheral conductive structures 16 extend between gaps 18 (e.g., plastic filled housing gaps) and can be used to form an inverted-F antenna resonating element that is shared between the first and second hybrid antennas. Slots may be formed in the structures of antenna structures 40. The slots form slot antenna resonating elements. The slot antenna resonating elements and the inverted-F antenna resonating element formed from structures 16 contribute to the overall response of the hybrid antennas.

As shown in FIG. 8, ground 104 may have an extended portion such as U-shaped portion 104' that forms slots for slot antenna resonating elements. Slot 148L is formed on the left-hand side of device 10 from the opening between elongated ground portion 104' on the left-hand side of device 10 and ground 104. Inner slot 148R is formed on the right-hand side of device 10 from the opening between elongated ground portion 104 on the right-hand side of device 10 and the ground 104. Switches SW2 and SW4 may be used to adjust the lengths of slots 148L and 148R and thereby adjust the frequency response of the slot antenna resonating elements formed from slots 148L and 148R.

Switches SW1 and SW3 and tunable components such as tunable inductors 102LA and 102LB bridge opening 144 between peripheral conductive structures 16 and ground 104. Switches SW1 and SW3 may be used in configuring the inverted-F antenna resonating element formed from peripheral conductive structures 16 to operate in either an unflipped or flipped configuration. When closed, switch SW1 (or switch SW3) may form a return path such as return path 110 of FIG. 5. Tunable inductors 102LA and 102LB may be used in tuning the inverted-F antenna resonating element. Other tuning components may be added to antenna structures 40 if desired.

Antenna structures 40 may be fed using feeds such as feeds 112A and 112B. The first hybrid antenna may be fed by positive antenna feed terminal 98A and ground antenna teed terminal 100A in feed 112A. The second hybrid antenna may be fed by positive antenna feed terminal 98B and ground antenna feed terminal 100B in feed 112B. Transmission lines may be used to couple feeds 112A and 112B to transceiver circuitry 90. In the example of FIG. 8, the first and second hybrid antennas are formed at upper end 20 of device 10. If desired, device 10 may be provided with a similar or identical set of hybrid antennas at lower end 22 (as an example).

Control circuitry 2$ can use impedance information, proximity sensor information, signal strength information, and/or other information to configure the antennas of device 10 in real time to optimize antenna performance. For example, control circuitry 28 can switch the upper or lower antenna structures into use and can also configure the selected antenna structures (upper or lower) to operate in either an unflipped or flipped configuration. The shapes and layouts of the conductive structures (e.g., peripheral conductive structures 16, ground portions 104, ground 104, switches SW1, SW2, SW3, SW4, inductors 102LA and 102LB, and feeds 112A and 112B) are symmetric with respect to central axis 142 (i.e., switch SW3 and SW1 are both located an equal distance from axis 142, etc.). The use of symmetric antenna structures 40 at the top and bottom ends of device 10 effectively provides device 10 with four different selectable antenna configurations (effectively antennas at each of the four corners of device 10), thereby enhancing the ability of device 10 to avoid undesired antenna blocking scenarios and other situations in which wireless performance might be degraded. If desired, multiplexing circuitry can be used to allow portions of the upper and lower antenna structures in device 10 to be used simultaneously (e.g., to handle respective communications bands).

When it is desired in use structures 40 in an unflipped configuration, switches SW1 and SW2 may be placed in an open (open circuit) configuration and switches SW3 and SW4 may be placed in a closed (short circuit) configuration. In this scenario, structures 40 form an unflipped hybrid antenna. Feed 112A serves as a feed for the hybrid antenna. Low band coverage in low band LB may be provided by portion LB(A) of peripheral conductive structures 16 (i.e., portion LB(A) of the inverted-F resonating element). Portion LB(A) of the inverted-F antenna resonating element terminates at the short circuit formed by closed switch SW3 across slot 144. Low band LB in the unflipped configuration may be tuned by adjusting tunable inductor 102LA. Inductor 102LB and switch SW1 are open in the unflipped configuration and therefore do not influence tuning. Low-midband coverage in band LMB may be provided by slot 148L, which forms low-midland slot resonating element LMB(A). Switch SW2 is open and therefore allows the full length of slot 148L to be used. Midband coverage in band MB may be provided by portion MB(A) of the inverted-F antenna resonating element formed by peripheral conductive structures 16 (extending from gap 18 to closed switch SW3). High band coverage in band HB may be provided by the slot resonating element formed from portion HB(A) of slot 148R, which has a closed end formed by closed switch SW4 and which extends to open end 150R.

When it is desired to use structures 40 in a flipped configuration, switches SW1 and SW2 may be closed and switches SW3 and SW4 may be opened. In this configuration, structures 40 form a flipped hybrid antenna that is identical as the unflipped antenna, but that is flipped with respect to central axis 142. In the flipped hybrid antenna configuration, feed 112B serves as a feed for the hybrid antenna. Low band coverage in low band LB may be provided by portion LB(B) of peripheral conductive structures 16 (i.e., portion LB(B) of the inverted-F resonating element). Portion LB(B) terminates at the short circuit formed by closed switch SW1 across slot 144). Low band LB in the flipped configuration may be tuned using tunable inductor 102LB. Inductor 102LA and switch SW3 may be opened. Low-midband coverage in band LMB may be provided by slot 148R, which forms low-midband slot resonating element LMB(B). Switch SW4 is open and therefore allows the full length of slot 148R to be used. Midband coverage in band MB may be provided by portion MB(B) of the inverted-F antenna resonating element formed by peripheral conductive structures 16 (extending from gap 18 to closed switch SW1). High band coverage in band HB may be provided by the slot resonating element formed from portion HB(B) of slot 148L, which has a closed end formed by closed switch SW4 and which extends to open end 150L.

Device 10 may be provided with an upper set of symmetric structures 40 in region 22 and a lower set of symmetric structures 40 in region 20. During operation, the upper structures may be configured to use the left or right feed and the lower structures may be configured to use the left or right feed to optimize antenna performance. If desired, the currently selected upper hybrid antenna may be used at the same time as the currently selected lower hybrid antenna (e.g., to implement a multiple-input-multiple-output scheme). Upper and tower antennas may be used to handle communications in different communications bands and/or in the same communications band.

Figure 9:
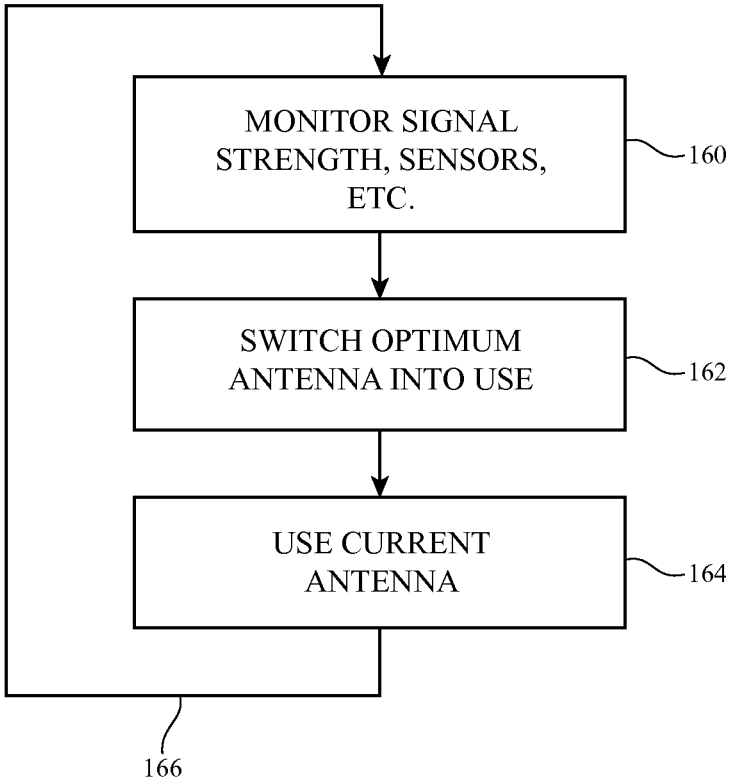
FIG. 9 is a flow chart of illustrative steps involved in operating an electronic device having antennas of the type shown in FIG. 8 in accordance with an embodiment.

Illustrative steps involved in operating an electronic device such as device 10 in a configuration in which device 10 has symmetric antenna structures 40 are shown in FIG. 9.

At step 160, control circuitry 28 may use antenna impedance measurement circuitry, sensors, and wireless circuitry to gather information on antenna loading, the proximity of external objects, signal strength, and other information on the operation of antennas in device 10.

At step 162, control circuitry 28 may use information on antenna operation to switch one or more optimum antennas into use to transmit and/or receive wireless traffic. If, for example, it is desired to use a set of symmetric antenna structures at one of the ends of device 10, control circuitry 28 can switch either the left-hand feed or right-hand feed at that end into use depending on which of these two feeds results in better data throughput or otherwise satisfies predetermined operating criteria. When the left-hand feed is used, structures 40 are placed in an unflipped configuration. When the right-hand feed is used, structures 40 are placed in a flipped configuration (in which switches and other components are reversed with respect to central axis 142). Both upper and lower symmetric antenna structures (or more such structures) may be configured in this way.

During the operations of step 164, the selected antenna(s) may be used to transmit and receive wireless data. This process may be performed continuously, as indicated by line 166.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having a central axis;

electrical components; and antenna structures in the housing that include antenna resonating element structures and the electrical components, wherein the antenna structures form first and second symmetrical halves divided by the central axis and the electrical components have a first configuration in which the antenna structures form a first antenna having a first antenna resonating element and a second configuration in which the antenna structures form a second antenna having a second antenna resonating element that includes a portion of the first antenna resonating element.

2. The electronic device defined in claim 1 wherein the second antenna is a version of the first antenna that has been flipped about the central axis.

3. The electronic device defined in claim 2 wherein the antenna resonating element structures include an inverted-F antenna resonating element arm.

4. The electronic device defined in claim 3 wherein the electrical components include a first switch in the first symmetrical half and a second switch in the second symmetrical half.

5. The electronic device defined in claim 4 wherein the first and second switches are coupled to the inverted-F antenna resonating element arm at equal distances from the central axis.

6. The electronic device defined in claim 5 further comprising a first antenna feed coupled to the inverted-F antenna resonating element arm in the first symmetrical half and a second antenna feed coupled to the inverted-F antenna resonating element arm in the second symmetrical half, wherein the first antenna feed and the second antenna feed are at equal distances from the central axis.

7. The electronic device defined in claim 6 wherein the first antenna resonating element comprises a first slot antenna resonating element in the first symmetrical half and the second antenna resonating element comprises a second slot antenna resonating element in the second symmetrical half.

8. The electronic device defined in claim 7 wherein the first antenna is a hybrid inverted-F-slot antenna formed from the inverted-F antenna resonating element arm and the first slot antenna resonating element in a configuration in which the second switch is closed and wherein the second antenna is a hybrid inverted-F-slot antenna formed from the inverted-F antenna resonating element arm and the second slot antenna resonating element in a configuration in which the first switch is closed.

9. The electronic device defined in claim 8 wherein the electrical components include a first tunable inductor in the first symmetrical half and a second tunable inductor in the second symmetrical half, wherein the first and second tunable inductors are coupled to the inverted-F antenna resonating element arm at equal distances from the central axis.

10. The electronic device defined in claim 9 wherein the second tunable inductor tunes the first hybrid inverted-F-slot antenna when the second switch is closed and the first switch is open and wherein the first tunable inductor tunes the second hybrid inverted-F-slot antenna when the first switch is closed and the second switch is open.

11. The electronic device defined in claim 10 wherein the housing includes peripheral conductive housing structures and wherein the inverted-F antenna resonating element arm includes at least a portion of the peripheral conductive housing structures.

12. The electronic device defined in claim 11 further comprising a third switch that bridges the first slot antenna resonating element in the first symmetrical half and fourth switch that bridges the second slot antenna resonating element in the second symmetrical half.

13. The electronic device defined in claim 12 wherein the third and fourth switches are located at equal distances from the central axis.

14. An electronic device, comprising:

a rectangular housing having peripheral conductive housing structures, wherein the rectangular housing has a central longitudinal axis;

antenna structures that exhibit mirror symmetry with respect to the central longitudinal axis and that include electrical components and an antenna resonating element formed from a portion of the peripheral conductive housing structures; and control circuitry that selectively places the electrical components in a selected one of:

a first configuration in which the antenna structures form a first hybrid inverted-F-slot antenna resonating element from the antenna resonating element; and a second configuration in which the antenna structures form a second hybrid inverted-F-slot antenna resonating element from the antenna resonating element.

15. The electronic device defined in claim 14 wherein the antenna resonating element formed from the portion of the peripheral conductive housing structures comprises an inverted-F antenna resonating element.

16. The electronic device defined in claim 15 wherein the central longitudinal axis divides the antenna structures into first and second symmetrical halves and wherein the antenna structures include a first slot antenna resonating element in the first half and a symmetrical second slot antenna resonating element in the second half.

17. The electronic device defined in claim 16 wherein the first hybrid inverted-F-slot antenna resonating element is formed from the first slot antenna resonating element and the second hybrid inverted-F-slot antenna resonating element is formed from and the second slot antenna resonating element.

18. The electronic device defined in claim 17 wherein the electrical components include first and second switches that respectively bridge the first and second slots at equal distances from the central longitudinal axis.

19. An electronic device, comprising:

a housing having peripheral conductive structures and characterized by a central axis; and an inverted-F antenna resonating element arm formed from the peripheral conductive structures;

an antenna ground that is separated from the inverted-F antenna resonating element arm by an opening; and first and second switches coupled between the inverted-F antenna resonating element arm and the antenna ground at equal distances from the central axis.

20. The electronic device defined in claim 19 further comprising a first slot antenna resonating element formed from an opening in the antenna ground on one side of the central axis and a symmetric second slot antenna resonating element formed from an opening in the antenna ground on an opposing side of the central axis.

* * * * *